US006779230B2

(12) United States Patent
Park et al.

(10) Patent No.: US 6,779,230 B2
(45) Date of Patent: Aug. 24, 2004

(54) AIR FLOW STRUCTURE FOR AN UPRIGHT-TYPE VACUUM CLEANER

(75) Inventors: Jung-seon Park, Gwangju (KR); Il-won Yang, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 329 days.

(21) Appl. No.: 10/138,978

(22) Filed: May 3, 2002

(65) Prior Publication Data

US 2003/0140445 A1 Jul. 31, 2003

(30) Foreign Application Priority Data

Jan. 31, 2002 (KR) ..... 2002-5619

(51) Int. Cl.[7] ..... A47L 9/10
(52) U.S. Cl. ..... 15/347; 15/351
(58) Field of Search ..... 15/347, 350, 351, 15/352, 353; 55/429, DIG. 3

(56) References Cited

U.S. PATENT DOCUMENTS 3,491,519 A 1/1970 Ettridge
5,617,611 A 4/1997 Wörwag
5,863,309 A * 1/1999 Louis et al. ..... 55/368
5,946,771 A * 9/1999 Bosyj et al. ..... 15/347
6,115,880 A 9/2000 Wulff et al.
6,317,920 B1 11/2001 Brickner et al.
6,609,270 B2 * 8/2003 Kim ..... 15/347

FOREIGN PATENT DOCUMENTS

JP 0066664 3/1998

* cited by examiner

*Primary Examiner*—Terrence R. Till
(74) *Attorney, Agent, or Firm*—Ladas & Parry

(57) ABSTRACT

An air flow structure for an upright-type vacuum cleaner having a body divided by a partition into a dust-collecting chamber having a dust bag and a motor driving chamber having a motor; an air suction port protruded at an upper part of the dust-collecting chamber in order to draw air thereinto, and having the dust bag disposed around the air suction port; a dust cover to cover the dust-collecting chamber and having a plurality of ribs disposed therein in a lengthwise direction, a concaved portion formed at a rear wall of the dust-collecting chamber in a lengthwise direction, and a grill portion formed between the dust-collecting chamber and the motor driving chamber in order to allow the air of the dust-collecting chamber to flow to the motor driving chamber.

3 Claims, 3 Drawing Sheets

AIR FLOW STRUCTURE FOR AN UPRIGHT-TYPE VACUUM CLEANER

BACKGROUND OF THE INVENTION

1. Field of the Invention

The present invention relates generally to an upright-type vacuum cleaner, and more particularly, to an air flow structure for an upright-type vacuum cleaner.

2. Description of the Prior Art

A conventional upright-type vacuum cleaner performs cleaning of a cleaning surface such as a floor or a carpet by drawing dust and dirt entrained in air from the outside by using a suction force generated inside of a cleaner body.

As shown in FIG. 1, the conventional upright-type vacuum cleaner has a suction brush 2 disposed at a lower part of the cleaner body 1. The upper inside of the cleaner body 1 has a dust-collecting chamber to embrace a dust bag and the lower inside of the cleaner body 1 has a motor driving chamber 30 having a motor. The dust-collecting chamber includes a dust cover 10. A handle 3 to move the suction brush 1 is disposed on an upper part of the cleaner body 1.

When the motor is driven in the above structure, a strong suction force is generated by the suction brush 2. The air containing dust and filth from the surface to be cleaned facing the suction brush 2 is drawn into the cleaner body 1 by the suction force. The drawn air is discharged through the dust bag in the dust-collecting chamber and into the motor driving chamber 30 through a grill portion disposed between the dust-collecting chamber and the motor driving chamber 30. The dust and dirt in the air is collected in the dust bag and filtered air is discharged to the outside through a discharging grill 40 after passing through the motor driving chamber 30.

When the dust and dirt are collected in the dust bag, the dust bag expands. If the dust bag expands enough to come into close contact with the inside of the dust-collecting chamber, the flow of the air is hindered, the suction force is weakened, and the motor is overloaded. Therefore, the vacuum cleaner has an air flow structure in the dust-collecting chamber.

FIG. 2 is an exploded perspective view showing an upright-type vacuum cleaner having a conventional air flow structure. As shown in FIG. 2, the conventional air flow structure has a plurality of ribs 11 disposed at the dust cover 10 in a lengthwise direction. Accordingly, the expanded dust bag is supported by the ribs 11, and thus some space for the air to flow is defined by the ribs 11 between the dust cover 10 and the dust bag.

However, in the above air flow structure, the ribs 11 are disposed in the dust cover 10 to form the air passage in front of the dust bag. However, the dust bag in the dust-collecting chamber 20 expands in both directions, front and back. Therefore, the air cannot flow easily at the back of the dust bag when fully expanded. Accordingly, there is a problem of weakening of the suction force of the vacuum cleaner when the dust bag expands, which causes the motor to be overloaded.

SUMMARY OF THE INVENTION

An object of the present invention is to provide an air flow structure for an upright-type vacuum cleaner to prevent weakening of the suction force and overloading of the motor due to the expansion of dust bag against the dust collecting chamber.

The above object is accomplished by providing an air flow structure for an upright-type vacuum cleaner comprising: a body divided by a partition into a dust-collecting chamber having a dust bag and a motor driving chamber having a motor; an air suction port protruding from an upper part of the dust-collecting chamber in order to draw in air, and having the dust bag disposed around the air suction port; a dust cover closing the dust-collecting chamber and having a plurality of ribs disposed therein in a lengthwise direction in order to form an air passage; a second air passage formed as a concave portion at the rear wall of the dust-collecting chamber, in a lengthwise direction; and a grill portion formed at the partition of the body in order to allow the air of the dust-collecting chamber to flow into the motor driving chamber.

Accordingly, a space for the air to flow both in back of and in front of the dust bag in the dust-collecting chamber is provided. Thus, weakening of the suction force and overloading of the motor due to the expansion of dust bag can be prevented or minimized.

BRIEF DESCRIPTION OF THE DRAWINGS

The object and features of the present invention will be more apparent by a description of the preferred embodiment of the present invention by referring to the appended drawings, in which.

DETAILED DESCRIPTION OF THE PREFERRED EMBODIMENT

The preferred embodiment of the present invention will be described in greater detail by referring to the appended drawing FIG. 3.

Figure 1:
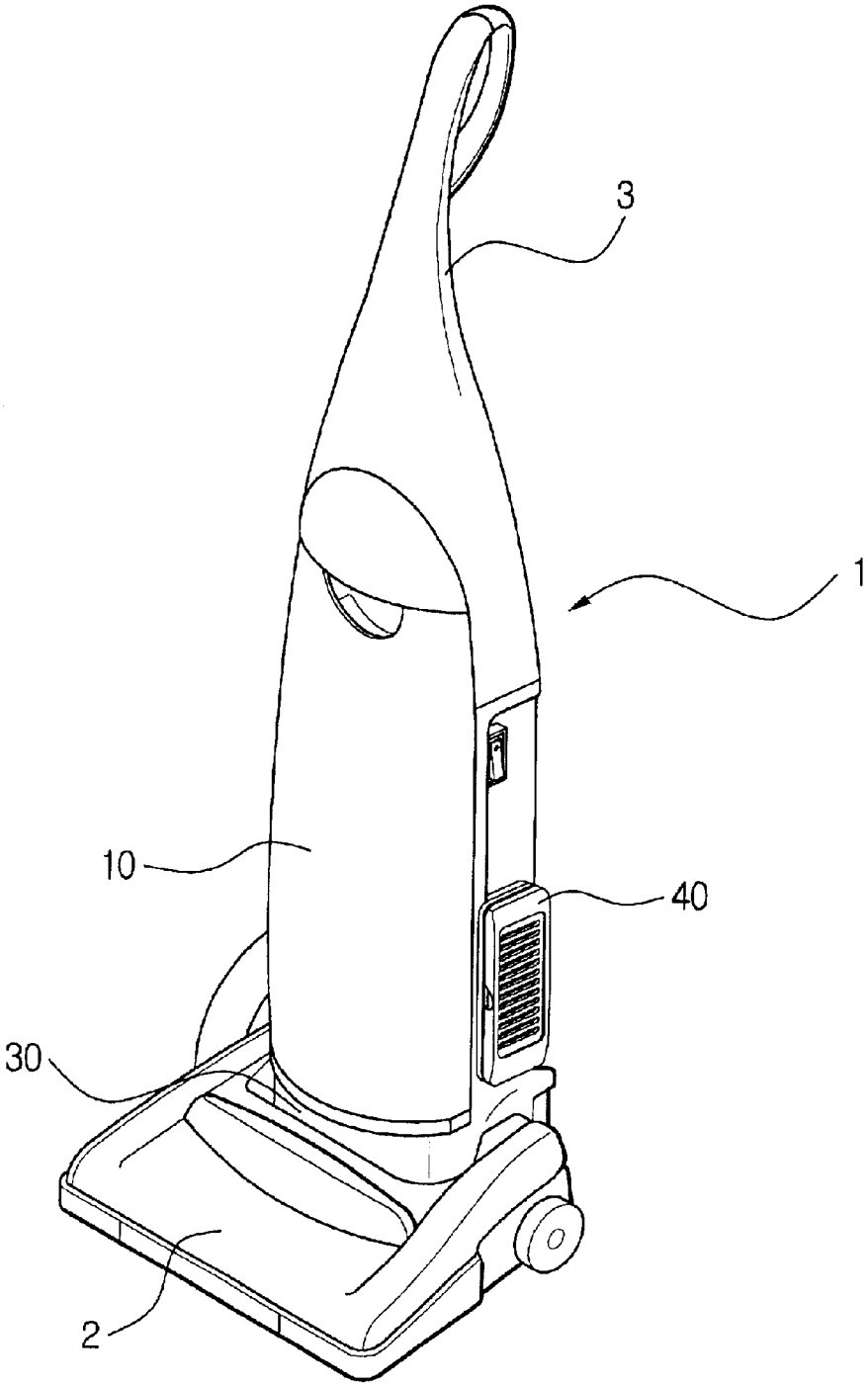
FIG. 1 (PRIOR ART)
FIG. 1 is a perspective view schematically showing the structure of a conventional upright-type vacuum cleaner.
Figure 2:
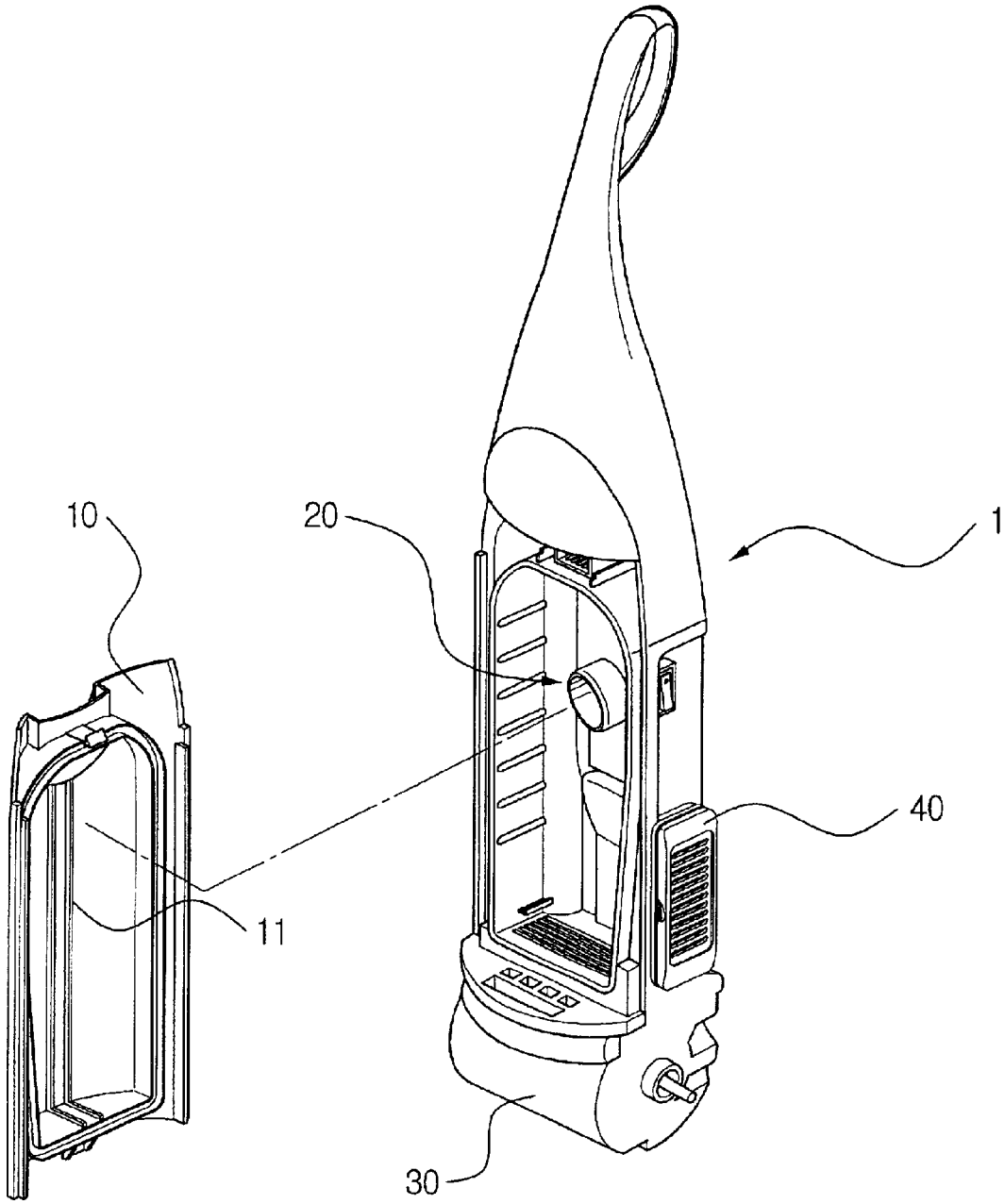
FIG.2 (PRIOR ART)
FIG. 2 is an exploded perspective view showing an upright-type vacuum cleaner applying a conventional air flow structure.
Figure 3:
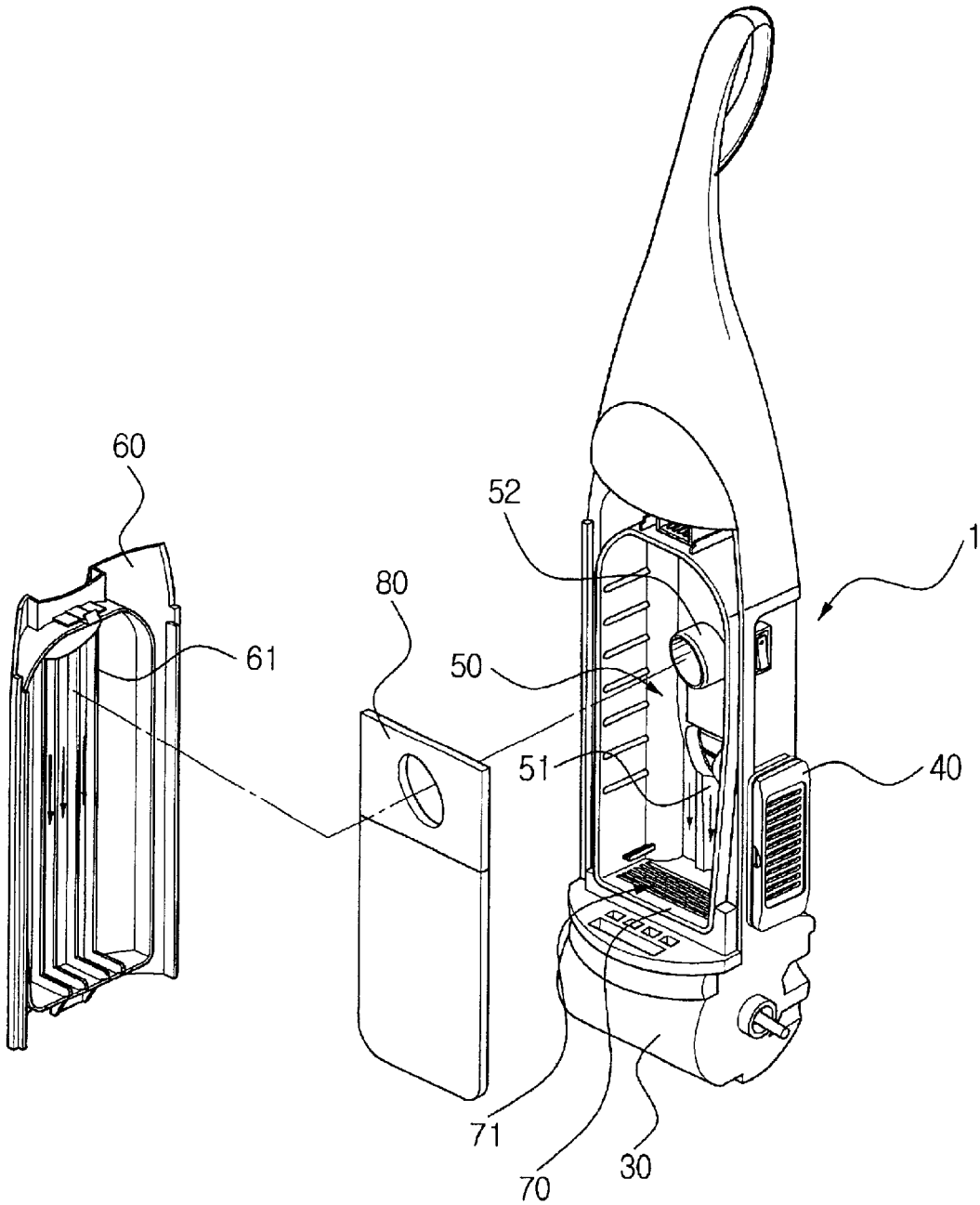
FIG. 3 is an exploded perspective view showing an upright-type vacuum cleaner applying an air flow structure according to the present invention.

As shown in FIG. 3, an air flow structure for an upright-type vacuum cleaner according to the present invention includes a body 1 divided into a dust-collecting chamber 50 and a motor driving chamber 30, a grill portion 71 to draw air through the dust-collecting chamber 50 and into the motor driving chamber 30, and a concave portion 51 formed at the rear wall of the dust-collecting chamber 50 as a second air passage.

The inside of the body 1 is divided by a partition 70 into the dust-collecting chamber 50 having a dust bag 80 and the motor driving chamber 30 having a motor (not shown). An air suction port 52 in communication with the outside is formed at an upper part of the dust-collecting chamber 50 to draw the outside air therethrough. The dust-collecting chamber 50 and the motor driving chamber 30 are in communication with each other through the grill portion 71 disposed in the partition 70. When the motor is driven and the suction force is generated in the motor driving chamber 30, the air of the dust-collecting chamber 50 is drawn into the motor driving chamber 30 through the grill portion 71. In addition, a discharging grill 40, to discharge the air from the motor driving chamber 30 to the outside, is disposed at a side of the cleaner body 1.

A dust cover 60 closes the dust-collecting chamber 50, and a plurality of ribs 61 are disposed at the inner wall of the dust cover 60. The ribs 61 are disposed in a lengthwise direction on the dust cover 60 so as to form one or more air passages.

The concave portion 51 is formed at the rear wall of the dust-collecting chamber 50 in a lengthwise direction. Accordingly, the second air passage for the air to flow is defined between the dust bag 80 in the air suction port 52 of the dust-collecting chamber 50 and the rear wall of the dust-collecting chamber 50. The concave portion 51 is formed at the rear wall of the dust-collecting chamber 50 to allow the air passed through the dust bag 80 to easily flow to the motor driving chamber 30 through the grill portion 71. In addition, the concave portion 51 is formed in a symmetrical manner with respect to the center line of the air suction port 52.

The operation of the upright-type vacuum cleaner applying the air flow structure according to the present invention will be described below.

When the motor in the cleaner body 1 is driven, a strong suction force is generated in the motor driving chamber 30. The dust and dirt on the surface to be cleaned is drawn into the dust bag 80 in the dust-collecting chamber 50 with the drawn air through a hose (not shown) and an air suction port 52, by the suction force. The drawn air flows into the dust-collecting chamber 50 after the dust and dirt is separated out by passing through the dust bag 80. The filtered air in the dust-collecting chamber 50 is drawn into the motor driving chamber 30 through the grill portion 71 and discharged to the outside of the cleaner body 1 through the discharging grill 40.

When the dust bag 80 expands, the dust bag 80 is supported by contact with the rear wall of the dust-collecting chamber 50 and the plurality of ribs 61 disposed at the dust cover 60. A space for the air to flow is formed between the inner wall of the dust cover 60 and the dust bag 80. Moreover, a space is defined between the rear wall of the dust-collecting chamber 50 and the dust bag 80 by the concave portion 51. Therefore, a passage for the filtered air passed through the dust bag 80 to flow to the motor driving chamber 30 through the grill portion 71 is defined in both the front and rear sides of the dust-collecting chamber 50.

According to the present invention constructed as above described, a passage for the air to flow is formed by the concave portion 51 formed on the rear wall of the dust-collecting chamber 50. Thus, an air passage is formed not only in the front of the dust bag 80 but also in the back of the dust bag 80. Accordingly, the suction force remains strong even when the dust bag 80 expands, and the motor is not overloaded.

The preferred embodiment of the present invention has been illustrated and described. However, the present invention is not limited to the preferred embodiment described here, and someone skilled in the art can modify the present invention without distorting the point of the present invention as claimed in the following claims.

What is claimed is:

1. An air flow structure for an upright-type vacuum cleaner comprising:

a body divided by a partition into a dust-collecting chamber having a dust bag and a motor driving chamber having a motor;

an air suction port protruding from an upper part of the dust-collecting chamber in order to draw air into the dust bag being disposed around the air suction port;

A dust cover to cover the dust-collecting chamber which has a plurality of ribs disposed therein in a lengthwise direction in order to form an air passage;

a second air passage formed as a concave portion at a rear wall of the dust-collecting chamber in a lengthwise direction; and a grill portion formed at the partition of the body in order to allow air to flow from the dust-collecting chamber to the motor driving chamber.

2. The air flow structure of claim 1, wherein the concave portion is formed at the rear wall of the dust-collecting chamber and extending from the air suction port to the partition.

3. The air flow structure of claim 1, wherein the concave portion is formed in a symmetrical manner with respect to a center line of the air suction port.

* * * * *